US007766302B2

(12) United States Patent
Lou

(10) Patent No.: US 7,766,302 B2
(45) Date of Patent: Aug. 3, 2010

(54) VARIABLE VALVE ACTUATOR WITH LATCHES AT BOTH ENDS

(75) Inventor: Zheng Lou, Plymouth, MI (US)

(73) Assignee: LGD Technology, LLC, Plymouth, MI (US)

( * ) Notice: Subject to any disclaimer, the term of this patent is extended or adjusted under 35 U.S.C. 154(b) by 514 days.

(21) Appl. No.: 11/825,980

(22) Filed: Jul. 9, 2007

(65) Prior Publication Data

US 2008/0054205 A1 Mar. 6, 2008

Related U.S. Application Data

(60) Provisional application No. 60/841,038, filed on Aug. 30, 2006.

(51) Int. Cl.
*F16K 31/00* (2006.01)

(52) U.S. Cl. ..... 251/63.6; 251/28; 251/63.5; 123/90.12; 123/90.15

(58) Field of Classification Search ..... 251/25, 251/26, 28, 62, 63, 63.5, 63.6; 123/90.12, 123/90.15

See application file for complete search history.

(56) References Cited

U.S. PATENT DOCUMENTS

| | | | | |
|---|---|---|---|---|
| 4,930,464 | A * | 6/1990 | Letsche | 123/90.12 |
| 5,595,148 | A * | 1/1997 | Letsche et al. | 123/90.12 |
| 5,809,950 | A * | 9/1998 | Letsche et al. | 123/90.12 |
| 6,167,853 | B1 * | 1/2001 | Letsche | 123/90.12 |
| 6,536,388 | B2 * | 3/2003 | Lou | 123/90.12 |
| 6,543,225 | B2 | 4/2003 | Scuderi | |
| 2005/0016475 | A1 | 1/2005 | Scuderi et al. | |

OTHER PUBLICATIONS

Schuderi Group, L.L.C., *Plaintiff* vs. *LGD Technology*, LLC and Zheng (David) Lou, Ph.D., Defendants, Civil Complaint, U.S. District Court, District of Massachusetts.

*Scuderi Group, LLC, Plaintiff* v. *LGD Technology*, LLC and Zheng (David) Lou, Ph.D., Defendents, Answer to Complaint, Affirmative Defenses, Counterclaims and Jury Demand.

*Scuderi Group, LLC, Plaintiff* v. *LGD Technology*, LLC and Zheng (David) Lou, Ph. D., Defendents, Answer to Defendent's Counterclaim and Affirmative Defenses.

* cited by examiner

*Primary Examiner*—John K Fristoe, Jr.

(57) ABSTRACT

Actuators and corresponding methods and systems for controlling such actuators offer efficient, fast, flexible control with large forces. In an exemplary embodiment, an fluid actuator includes a housing having first and second fluid ports, an actuation cylinder in the housing defining a longitudinal axis and having first and second ends in first and second directions, an actuation piston in the cylinder with first and second surfaces moveable along the longitudinal axis, a spring subsystem biasing the actuation piston to a neutral position, a first fluid space defined by the first end of the actuation cylinder and the first surface of the actuation piston, and a second fluid space defined by the second end of the actuation cylinder and the second surface of the actuation piston. A first flow mechanism controls fluid communication between the first fluid space and the first port, whereas a second flow mechanism controls fluid communication between the second fluid space and the second port. The first and second flow mechanisms are substantially restricted through two integrated snubbing mechanisms when the actuation piston approaches the first and second direction ends of its travel, respectively. In addition to a differential fluid force on the actuation piston, there is a centering or returning spring force available to help open the engine valve against the high cross-over passage pressure, without the need for the fluid actuation system to be bulky and consume too much energy.

15 Claims, 7 Drawing Sheets

VARIABLE VALVE ACTUATOR WITH LATCHES AT BOTH ENDS

REFERENCE TO RELATED APPLICATION

This application claims priority to Provisional U.S. Patent Application No. 60/841,038, file on Aug. 30, 2006, the entire content of which are incorporated herein by reference.

FIELD OF THE INVENTION

This invention relates generally to actuators and corresponding methods and systems for controlling such actuators, and in particular, to actuators offering efficient, fast, flexible control with large forces.

BACKGROUND OF THE INVENTION

A split four-stroke cycle internal combustion engine is described in U.S. Pat. No. 6,543,225 and U.S. Publication No. US2005/0016475A1. It includes at least one power piston and a corresponding first or power cylinder, and at least one compression piston and a corresponding second or compression cylinder. The power piston reciprocates through a power stroke and an exhaust stroke of a four-stroke cycle, while the compression piston reciprocates through an intake stroke and a compression stroke. A pressure chamber or cross-over passage interconnects the compression and power cylinders, with an inlet check valve providing substantially one-way gas flow from the compression cylinder to the cross-over passage, and an outlet or cross-over valve providing gas flow communication between the cross-over passage and the power cylinder. The engine further includes an intake and an exhaust valve on the compression and power cylinders, respectively. The split-cycle engine according to the referenced patent and other related developments potentially offers many advantages in fuel efficiency, especially when integrated with an additional air storage tank interconnected with the cross-over passage, which makes it possible to operate the engine as an air hybrid engine. Relative to an electrical hybrid engine, an air hybrid engine can potentially offer as much, if not more, fuel economy benefits at much lower manufacturing and waste disposal costs.

To achieve the potential benefits, the air or air-fuel mixture in the cross-over passage has to be maintained at a predetermined firing condition pressure, e.g. approximately 270 psi or 18.6 bar gage-pressure, for the entire four stroke cycle. The pressure may go much higher to achieve better combustion efficiency. Also, the opening window of the cross-over valve has to be extremely narrow, especially at medium and high engine speeds. The cross-over valve opens when the power piston is at or near the top dead center (TDC) and closes shortly after that. The total opening window in a split cycle engine may be as short as one to two milliseconds, compared with a minimum period of six to eight milliseconds in a conventional engine. To seal against a persistently high pressure in the cross-over passage, a practical cross-over valve is most likely a poppet or disk valve with an outward (i.e. away from the power cylinder, instead of into it) opening motion. When closed, the valve disk or head is pressured against the valve seat under the cross-over passage pressure. To open the valve, an actuator has to provide an extremely large opening force to overcome the pressure force on the head as well as the inertia. The pressure force will drop dramatically once the cross-over valve is open because of a substantial pressure-equalization between the cross-over passage and the power cylinder. Once the combustion is initiated, the valve should be closed as soon as desired to prevent the spread of the combustion into the cross-over passage, which also entails a need, during a certain period of combustion, to keep the valve seated against a power cylinder pressure that is higher than the cross-over passage pressure. In addition, the cross-over valve needs to be deactivated when the power stroke is not active in certain phases of the air hybrid operation. Like conventional engine valves, the seating velocity of the cross-over valve has to be kept under a certain limit to reduce noise and maintain adequate durability.

In summary, the cross-over valve actuator has to offer a large opening force, a substantial seating force, a reasonable seating velocity, a high actuation speed, and timing flexibility while consuming minimum energy by itself. Most, if not all, engine valve actuation systems are not able to meet these demands.

SUMMARY OF THE INVENTION

Briefly stated, in one aspect of the invention, one preferred embodiment of an fluid actuator includes a housing having first and second fluid ports, an actuation cylinder in the housing defining a longitudinal axis and having first and second ends in first and second directions, an actuation piston in the cylinder with first and second surfaces moveable along the longitudinal axis, a spring subsystem biasing the actuation piston to a neutral position, a first fluid space defined by the first end of the actuation cylinder and the first surface of the actuation piston, and a second fluid space defined by the second end of the actuation cylinder and the second surface of the actuation piston. A first flow mechanism controls fluid communication between the first fluid space and the first port, whereas a second flow mechanism controls fluid communication between the second fluid space and the second port. The first and second flow mechanisms are substantially restricted through two integrated snubbing mechanisms when the actuation piston approaches the first and second direction ends of its travel, respectively.

In operation, the spring subsystem, the actuation piston, and the actuator load (e.g., an engine valve) work as a spring-mass pendulum system, efficiently converting the potential energy in the spring subsystem to the kinetic energy in the moving mass and vice versa. The efficient energy conversion also leaves less energy for the snubbing mechanisms to dissipate and provides better soft seating for the engine valve. The actuation efficiency is further helped by utilizing two actuation 3-way valves, with one of them being switched to the high pressure fluid purposely at a later time during the engine valve return travel.

The system is able to latch the actuation piston at each end of its travel. The actuation piston does not have to, if desired, contact the end of the actuation cylinder for it to be latched. The piston may achieve a substanially steady balance simply through a combination of fluid forces and the net spring force.

In another embodiment, the actuator is supplied and controlled by a 4-way actuation switch valve. Each of the 4-way and 3-way valves may be a proportional valve when desired.

In another embodiment, a spring controller allows the engine valve to close at power-off even without sufficient pressure in the cross-over passage.

The present invention provides significant advantages over the prevailing fluid actuators and their control. Its ability to latch the actuator at both ends is important or critical in applications where an engine valve has to be held at open for a controllable period of time. The fluid nature of the actuator provides high force and power density to deal with the demanding requirements of a cross-over valve, and yet the spring-pendulum mechanism is able to offer high energy efficiency. The control approaches associated with various switch valves are able to deal with varying application needs, especially those for an air hybrid engine. With its pendulum arrangement, there is a centering or returning spring force available, in addition to a differential fluid force, to help open the engine valve against the high cross-over passage pressure, without the need for the fluid actuation system to be bulky and consume too much energy.

The present invention, together with further objects and advantages, will be best understood by reference to the following detailed description taken in conjunction with the accompanying drawings.

DETAILED DESCRIPTION OF THE INVENTION

Figure 1:
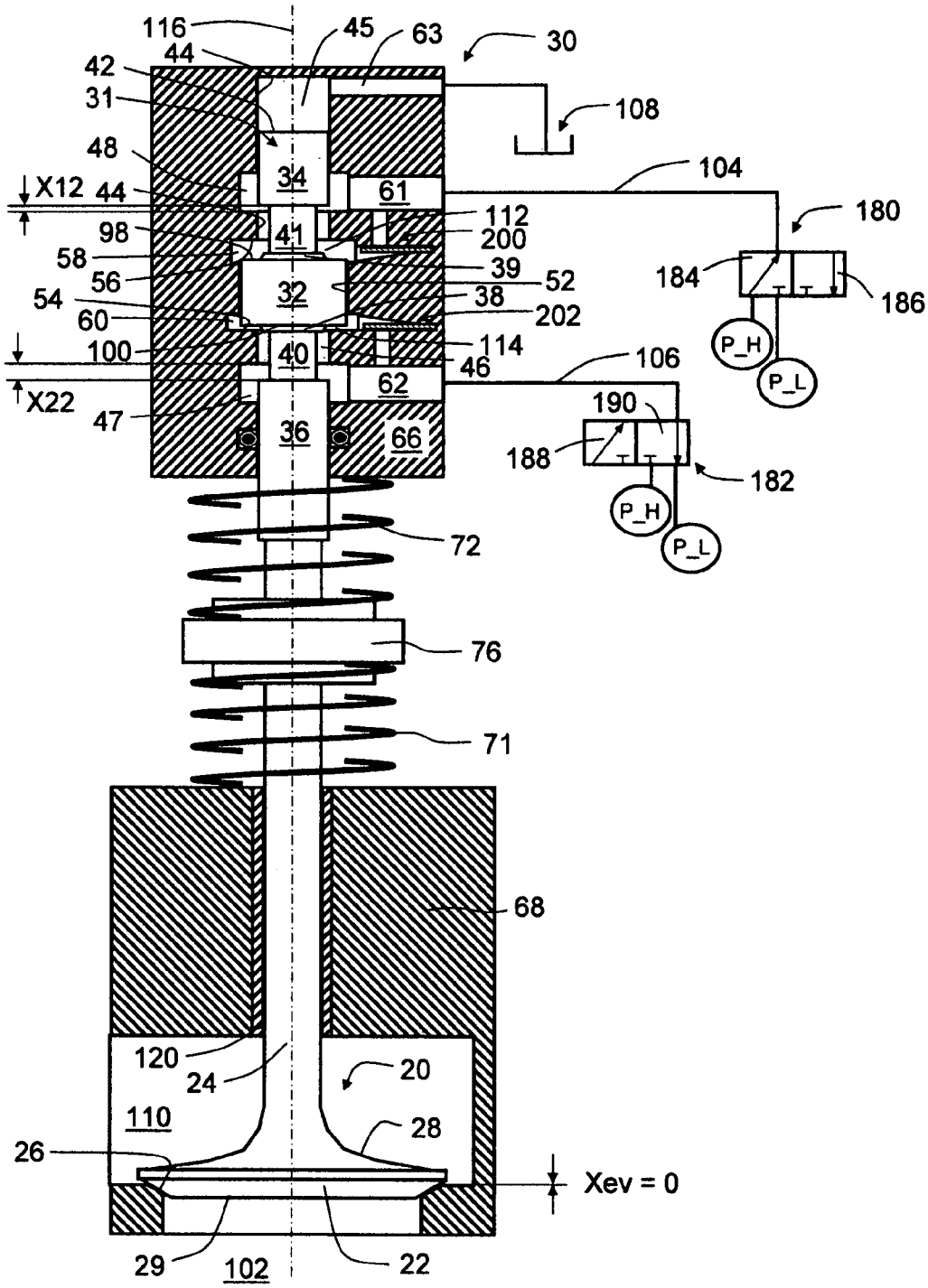
FIG. 1 is a schematic illustration of one preferred embodiment of the valve actuator, which is at a closed state.

Referring now to FIG. 1, a preferred embodiment of the invention provides an engine valve control system using one actuation piston, and a set of centering spring means. The system comprises an engine valve 20, a fluid actuator 30, a first actuation 3-way valve 180, a second actuation 3-way valve 182, a pair of actuation springs 71 and 72.

The first and second actuation 3-way valves 180 and 182 supply the fluid actuator 30 through a first port 61 (via a first-port passage 104) and a second port 62 (via a second-port passage 106), respectively. The first port 61 and the first-port passage 104 may be a physically or functionally continuous part, and so do the second port 62 and the second-port passage 106. Each of the 3-way valves 180 and 182 has two ports connected with a low-pressure P_L fluid line and a high-pressure P_H fluid line, and the third or remaining port connected with one of the two port passages 104 and 106.

The 3-way valve 180 is switched either to a left position 184 or a right position 186. At the left and right positions 184 and 186, the first-port 61 is in fluid communication with the P_H and P_L lines, respectively. The 3-way valve 182 is switched either to a left position 188 or a right position 190. At the left and right positions 188 and 190, the second-port 62 is in fluid communication with the P_H and P_L lines, respectively.

The pressure P_H can be either constant or continuously variable. When variable, it is controlled to accommodate variability in system friction, engine valve opening, air pressure, the engine valve seating velocity requirement, etc. and/or to save operating energy when possible. A higher P_H value helps overcome higher system friction and air pressure force, and increase the engine valve opening speed, whereas a lower P_H value is better for softer seating of the engine valve and for saving energy. The low pressure P_L can be simply the fluid tank pressure, the atmosphere pressure, or a fluid system backup pressure. The fluid system backup pressure can be simply supported or controlled, for example, by a spring-loaded check valve, with or without an accumulator. The P_L value is preferred to be as low as possible to increase the system efficiency, and yet high enough to help prevent fluid cavitation or starvation. When necessary, the low pressure P_L can be more tightly controlled as well.

The engine valve 20 includes an engine valve head 22 and an engine valve stem 24. The engine-valve head 22 includes a first surface 28 and a second surface 29, which in the case of a split-cycle engine, are exposed to a cross-over passage 110 and the engine cylinder 102, respectively. The engine valve 20 is operably connected with the fluid actuator 30 along a longitudinal axis 116 through the engine valve stem 24, which is slideably disposed in an engine valve guide 120. When the engine valve 20 is fully closed, the engine valve head 22 is in contact with an engine valve seat 26, sealing off the fluid communication between the cross-over passage 110 and the engine cylinder 102.

The fluid actuator 30 comprises an actuator housing 66, within which, along the longitudinal axis 116 and from a first to a second direction (from the top to the bottom in the drawing), there are a first bore 44, an actuation cylinder 52, and a second bore 46. The actuation cylinder 52 includes a first end 56 and a second end 54. The first and second bores 44 and 46 are interrupted by a first-bore undercut 48 and a second-bore undercut 47, respectively. Within these hollow elements from the first to the second direction lies a shaft assembly 31 comprising a first piston rod 34, a first-piston-rod neck 41, a first-piston-rod shoulder 39, an actuation piston 32, a second-piston-rod shoulder 38, a second-piston-rod neck 40, and a second piston rod 36. The first and second piston rods 34 and 36 are slideably disposed in and substantially supported in the radial direction by the first and second bores 44 and 46, respectively. The actuation piston 32 is slideably disposed in the actuation cylinder 52.

The radial clearances between the above sliding surfaces are substantially tight, provide substantial fluid seal, and yet offer tolerable resistance to relative motions, including translation along and, if desired, rotation around the longitudinal axis 116, between the shaft assembly 31 and the housing 66.

The actuation piston 32 includes a first surface 98 and a second surface 100, and longitudinally divides the actuation cylinder 52 into a first fluid space 112 (a fluid volume between the actuation-cylinder first end 56 and the actuation-piston first surface 98) and a second fluid space 114 (a fluid volume between the actuation-piston second surface 100 and the actuation-cylinder second end 54).

The fluid actuator 30 further includes a first reed valve 200 and a second reed valve 202. The first reed valve 200 provides substantially one-way fluid communication from the first port 61 to the first fluid space 112, which is facilitated by an actuation-cylinder first undercut 58. The second reed valve 202 provides substantially one-way fluid communication from the second port 62 to the second fluid space 114, which is facilitated by an actuation-cylinder second undercut 60.

Concentrically wrapped around the engine valve stem 24 and the second piston rod 36, respectively, are a first actuation spring 71 and a second actuation spring 72. The second actuation spring 72 is supported by the housing 66 (or any spring retaining feature, not shown in FIG. 1, connected with the housing 66) and a central spring retainer 76, whereas the first actuation spring 71 is supported by the central spring retainer 76, and the cylinder head 68 (or any spring retaining feature, not shown in FIG. 1, connected with the cylinder head 68). The actuation springs 71 and 72 are preferably under compression.

The central spring retainer 76 is operably connected with the engine valve stem 24 and the second piston rod 36. Some part or element of this connection can be a simple mechanical contact as long as they move inseparably, which may be secured for example by designing proper spring preloads. If desired, the retainer 76 can be designed into two separate retainers (not shown in the figures).

The first-piston-rod and second-piston-rod shoulders 39 and 38 are intended to work with the first and second bores 44 and 46 as snubbing or flow-restricting mechanism to slow down the shaft assembly 31 near the end of its travel in the first and second directions, respectively.

The actuation cylinder 52 offers substantial room in the second direction such that the actuation piston 32 does not contact its second end 54 at any operating condition. When the engine valve 20 is seated as shown in FIG. 1, there is still a longitudinal distance between the actuation-piston second surface 100 and the actuation-cylinder second end 54 to accommodate the engine valve lash adjustment.

In the first direction, there are two design and operating options. In the first option, the shaft assembly 31 is balanced at the steady state by fluid forces and the net spring force before the actuation-piston first surface 98 reaches the actuation-cylinder first end 56. In the second option, the shaft assembly 31 is balanced at the steady state by fluid forces, the net spring force, and the contact force resulting from the contact between the actuation-piston first surface 98 and the actuation-cylinder first end 56.

The shaft assembly 31 is generally under two longitudinal fluid forces on the actuation-piston first and second surfaces 98 and 100. The effective pressure areas of the two surfaces 98 and 100 are influenced by the diameters of the first and second piston rods 34 and 36. A first chamber 45, distal to a first-piston-rod end surface 42, is either in communication with a fluid tank 108 through a third port 63 to collect the leaked fluid as shown in FIG. 1, or in direct communication with the atmosphere (see FIG. 4). The fluid tank 108 is preferably the same tank the rest of the fluid system uses. The first-piston-rod end surface 42 is therefore not exposed to any substantial pressure or pressure force.

The engine valve head 22 is generally exposed to the pressure of the crossover valve passage on the first surface 28 and the pressure of the engine cylinder 102 on the second surface 29.

The system also experiences various friction forces, steady-state flow forces, transient flow forces, and other inertia forces. Steady-state flow forces are caused by the hydrostatic pressure redistribution due to flow-induced velocity variation, i.e. the Bernoulli effect. Transient flow forces are fluid inertial forces. Other inertial forces result from the acceleration of objects, excluding fluid here, with inertia, and they are substantial in an engine valve assembly because of the large magnitude of the acceleration or the fast timing.

The fluid flow control within the actuator 30 can be considered to include a first flow mechanism, a second flow mechanism, and the first and second reed valves 200 and 202. The first flow mechanism and the first reed valve 200 control fluid communication between the first fluid space 112 and the first port 61. The second flow mechanism and the second reed valve 2002 control fluid communication between the second fluid space 114 and the second port 62.

The first flow mechanism, for the embodiment illustrated in FIG. 1, involves the first-bore undercut 48, an annular space between the first bore 44 and the first-piston-rod neck 41, the first piston rod 34, and the first-piston-rod shoulder 39. The first flow mechanism is substantially open when the annular space between the first bore 44 and the first-piston-rod neck 41 is substantially open both to the first fluid space 112 and the first-bore undercut 48. When the actuation piston 32 is near or at the first direction end of its travel, the first-piston-rod shoulder 39 protrudes into the annular space between the first bore 44 and the first-piston-rod neck 41, resulting in flow restriction and thus snubbing function. The underlap X12 between the first-bore undercut 48 and the first piston rod 34 is generally of a sufficient length, regardless the position of the piston 32 so as not to cause flow restriction. If necessary or desired, the underlap X12 can be designed to be substantially short when the actuation piston 32 is near or at the second direction end of its travel (as shown in FIG. 1) to introduce a certain amount of flow restriction. The first reed valve 200 is optional and is intended to allow for a one-way flow from the first port 61 to the first fluid space 112 to bypass the flow restriction through the first flow mechanism, helping quickly fill the first fluid space 112 at the beginning of the piston travel in the second direction. The first flow mechanism may optionally not include the first-bore undercut 48, with the first-piston-rod neck 41 being extended further in the first direction so that the annular space between the first bore 44 and the first-piston-rod neck 41 directly opens to the first port 61.

The second flow mechanism, for the embodiment illustrated in FIG. 1, involves the second-bore undercut 47, an annular space between the second bore 46 and the second-piston-rod neck 40, the second piston rod 36, and the second-piston-rod shoulder 38. The second flow mechanism is substantially open when the annular space between the second bore 46 and the second-piston-rod neck 40 is substantially open both to the second fluid space 114 and the second-bore undercut 47. When the actuation piston 32 is near or at the second direction end of its travel as shown in FIG. 1, the second-piston-rod shoulder 38 protrudes into the annular space between the second bore 46 and the second-piston-rod neck 40, resulting in flow restriction and thus snubbing function. The underlap X22 between the second-bore undercut 47 and the second piston rod 36 is generally of a sufficient length, regardless the position of the piston 32 so as not to cause flow restriction. If necessary or desired, the underlap X22 can be designed to be substantially short when the actuation piston 32 is near or at the first direction end of its travel to introduce a certain amount of flow restriction. The second reed valve 202 is optional and is intended to allow for a one-way flow from the second port 62 to the second fluid space 114 to bypass the flow restriction through the second flow mechanism, helping quickly fill the second fluid space 114 at the beginning of the piston travel in the first direction. The second flow mechanism may optionally not include the second-bore undercut 47, with the second-piston-rod neck 40 being extended further in the second direction so that the annular space between the second bore 46 and the second-piston-rod neck 40 directly opens to the second port 62.

Power-Off State

There are two possible power-off states for the fluid actuator 30 in a split cycle engine. One of them is when the engine or power is off while the cross-over passage 110 is still sufficiently pressurized, especially for an air-hybrid application with an air storage tank. The high and low pressure fluid sources P_H and P_L are all at low or zero gage pressure. The total fluid force on the actuation piston 32 is substantially equal to zero. Still, the pressure in the cross-over passage 110 is able to overcome the centering spring force, hold the engine valve 20 against the valve seat 26, and keep the fluid actuator 30 in a state substantially like that shown in FIG. 1.

At the other power-off state, when the cross-over passage 110 is not sufficiently pressurized, the engine valve is balanced primarily by the net spring force and stays about half open (not shown in FIG. 1). The actuation piston 32 is halfway between its two end positions.

At the power-off, the first and second actuation 3-way valves 180 and 182 are preferably, but not necessarily, in their left and right positions 184 and 190, respectively, as shown in FIG. 1 so that they do not have to be switched at the next start-up.

Start-Up

To start-up the system from the power-off state, all fluid supply sources are pressurized, and the actuation 3-way valves 180 and 182 are secured at their positions as shown in FIG. 1, which then leads a differential pressure between the first and second fluid spaces 112 and 114, causing the engine valve 20 either to be secured at or to be driven to a closed position as shown in FIG. 1.

Valve Opening and Closing

Figure 2:
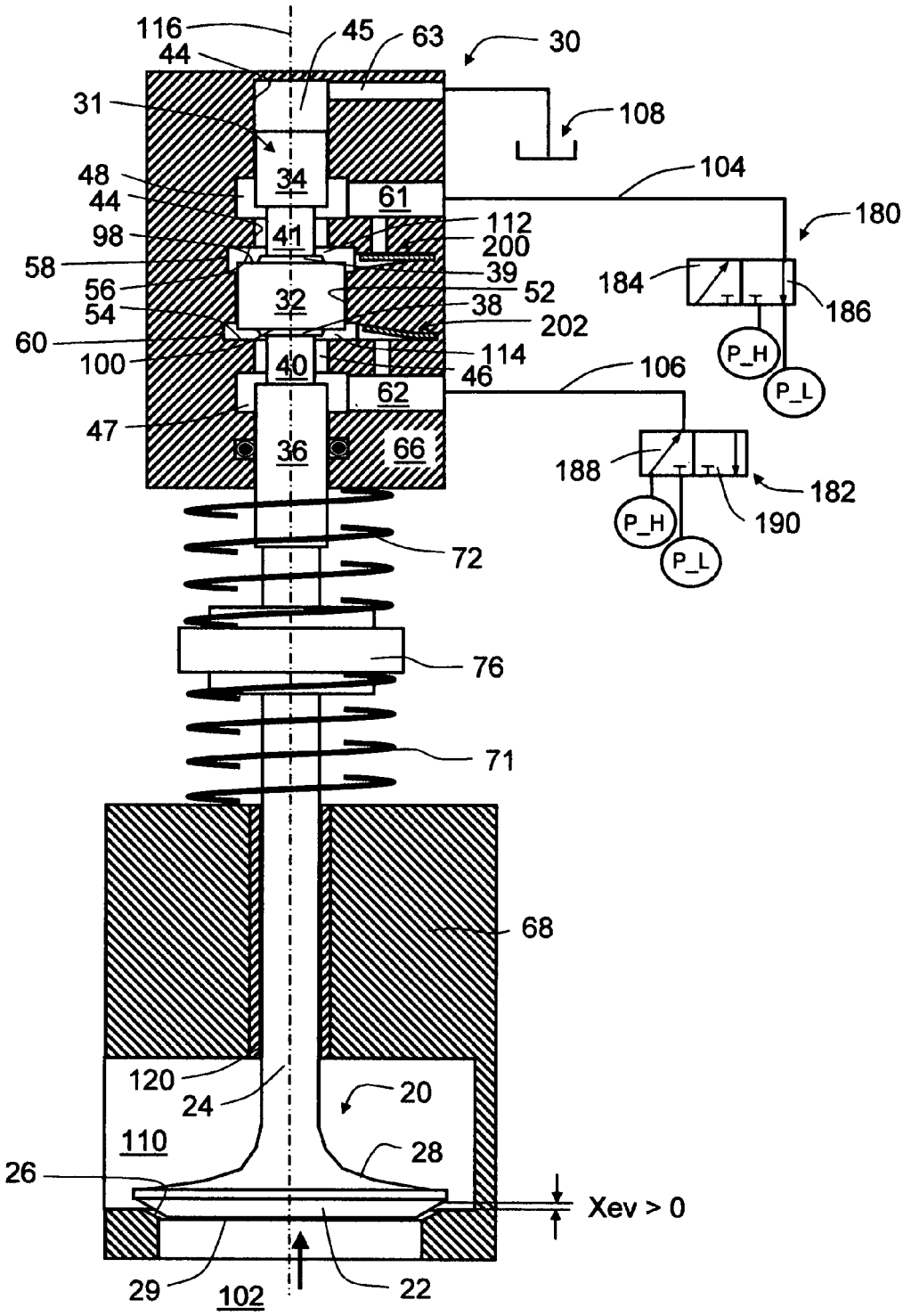
FIG. 2 is a schematic illustration of one preferred embodiment of the valve actuator, which starts opening up an engine valve.

To open the engine valve 20, the first and second actuation 3-way valves 180 and 182 are switched to their right and left positions 186 and 188, respectively, as shown in FIG. 2. The first fluid space 112 is in communication with the low pressure P_L supply through the first flow mechanism. The first reed valve is kept closed because of an unfavorable pressure direction. The second fluid space 114 is in communication with the high pressure P_H supply through the second flow mechanism and the second reed valve 202, which is under a differential pressure in favor of opening and helps alleviate potential cavitation or starvation in the second fluid space 114, especially during the initial period of the travel when the second flow mechanism is restrictive. The differential pressure force on the actuation piston 32 works with the net spring returning force in the first direction to overcome the differential air pressure force on the engine valve, which is in the second direction because of the high pressure in the cross-over passage 110.

The actuation piston 32 travels from the second-direction end position to its first-direction end position, the net spring force changes from its maximum return force in the first direction to its maximum return force in the second direction. The net spring force can be zero either at the central point of the travel or, if desired, at a point which is off the center. In air-hybrid engine applications, the pressure in the cross-over passage 110 is substantially constant because of the air storage tank. The pressure in the engine cylinder 102 is initially low, increases rapidly as soon as the engine valve 20 opens, and eventually reaches a value substantially equal to the pressure in the cross-over passage 110.

As the actuation piston 32 approaches its first-direction end position, the first-piston-rod shoulder 39 starts approaching or protruding into the first bore, increasing the flow resistance in the first flow mechanism, and causing a substantial pressure rise in the first fluid space 112, resulting in a snubbing action to dramatically slow down the piston velocity. In addition, with the two-spring pendulum design, the speed of the shaft assembly 31 is already substantially reduced at this point due to an increasing net spring return force in the second direction. Finally, the system reaches a steady state, with the differential pressure force in the first direction balances out the net spring return force in the second direction, a much reduced differential air force on the engine valve, and potentially a contact force between the actuation-cylinder first end 56 and the actuation-piston first surface 98 if they are in contact either by design and/or by operating conditions.

Figure 3:
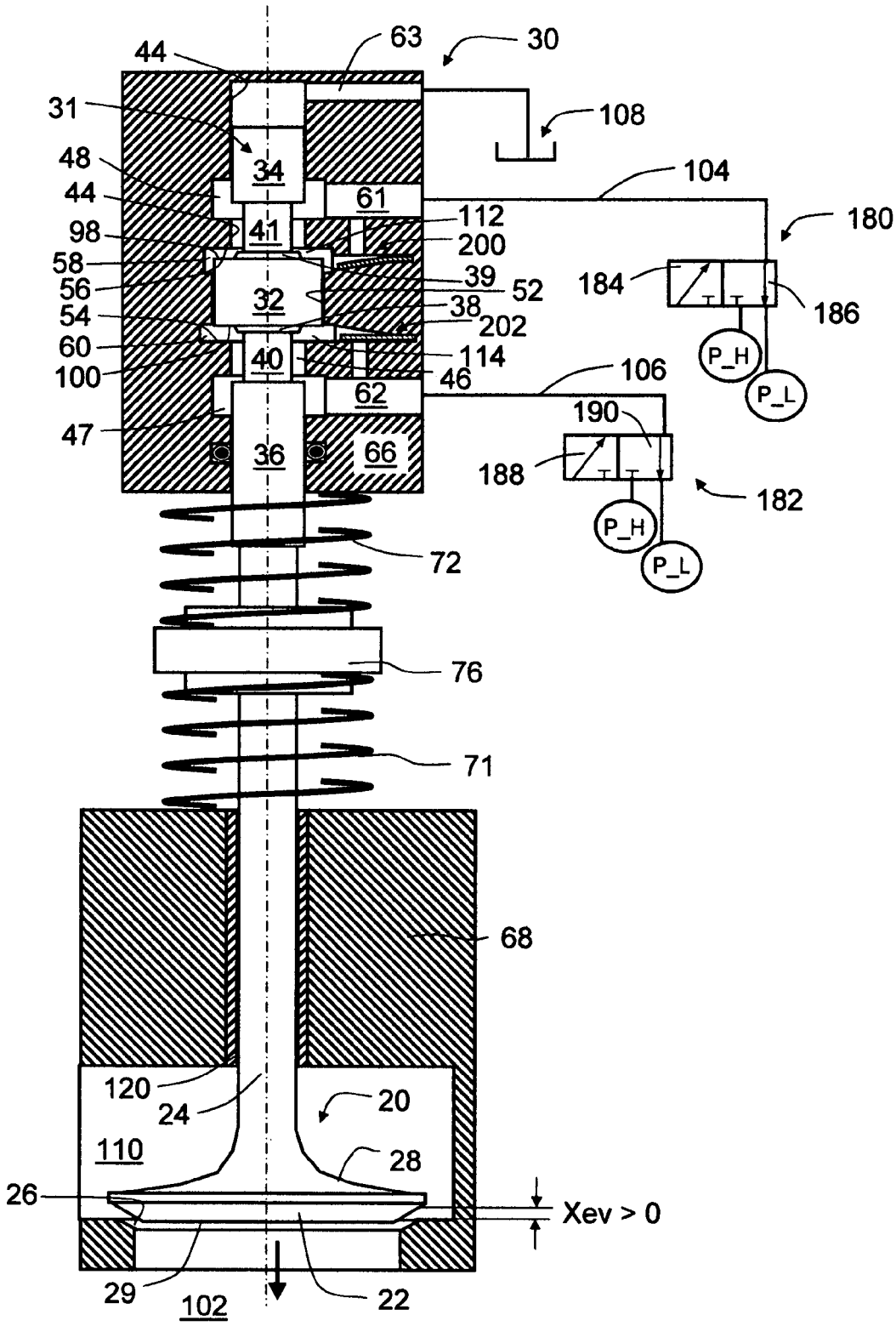
FIG. 3 is a schematic illustration of one preferred embodiment of the valve actuator, which starts closing an engine valve.

The closing process of the engine valve 20 is substantially the opposite of the opening process. There are important differences though. Once the engine valve 20 is wide-open, there is not substantial pressure differential on the engine valve. The fluid actuator 30 does not have to overcome major air pressure force to close the engine valve 20. To reduce the energy consumption and to help achieve softer engine valve seating or landing, one may optionally keep, during a substantial, initial period of the closing process, the first actuation 3-way valve 180 at its right position while switching the second actuation 3-way valve 182 to its right position as shown in FIG. 3, resulting in a substantially low differential fluid pressure on the actuation piston 32. The closing motion is therefore substantially driven by the net spring return force alone during this initial period. The first actuation 3-way valve 180 can be switched to its left position 184 at a later stage or time of the engine valve closing process to secure and latch the engine valve 20 at the closed position, against the net spring return force in the first direction and the differential air pressure force on the engine valve 20 in the first direction, which happens when the engine cylinder pressure exceeds the cross-over passage pressure due to combustion. The exact timing for switching the first actuation 3-way valve 180 to its left position can be controlled based on engine operating conditions, including the engine RPM, load, and fluid temperature or viscosity.

The second-piston-rod shoulder 38 works with the second bore 46 to increase flow resistance in the second flow mechanism and to create a snubbing action during the engine valve seating process.

Figure 4:
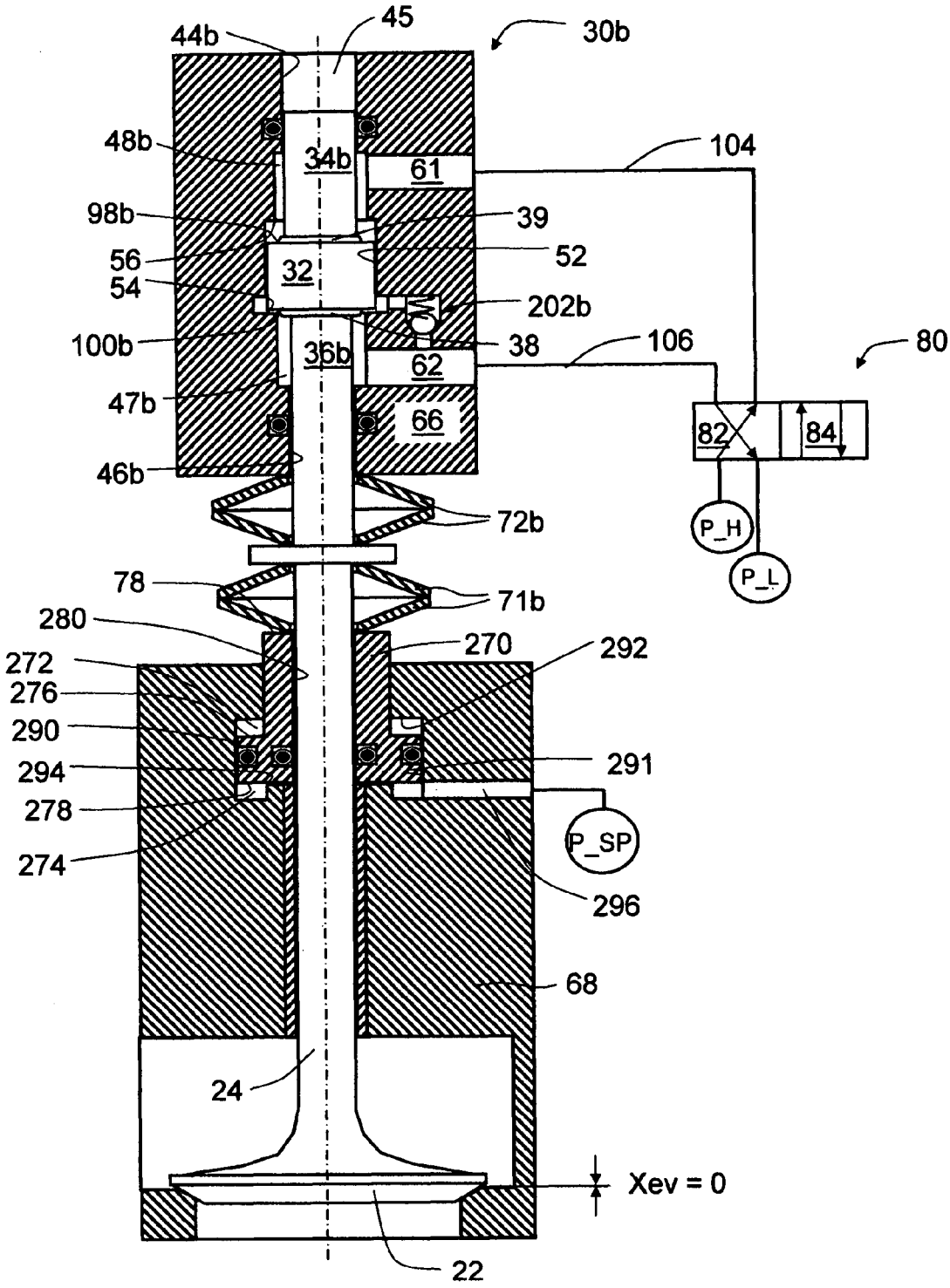
FIG. 4 is a schematic illustration of another preferred embodiment, which utilizes one four-way actuation valve and Belleville springs, and offers a variation in flow mechanism design.

FIG. 4 depicts an alternative embodiment of the invention that utilizes one 4-way switch valve 80, instead of the first and second actuation 3-way valves 180 and 182 as in FIGS. 1-3. The valve 80 is a 2-position 4-way valve. It has four ports connected with the low-pressure P_L fluid supply, the high-pressure P_H fluid supply, the first-port passage 104, and the second-port passage 106. It is switched either to a left position 82 or and a right position 84. At the left position as shown in FIG. 4, the first-port and second-port passages 104 and 106 are in fluid communication with the P_H and P_L lines, respectively. At the right position (not shown in FIG. 3), the first-port and second-port passages 104 and 106 are in fluid communication with the P_L and P_H lines, respectively.

The embodiment in FIG. 4 is equipped with the first and second actuation springs of the Belleville type 71*b* and 72*b*, each of which includes at least one coned disk. In each spring, two or more coned disks may be stacked in series (as shown in FIG. 4) or in parallel.

The embodiment in FIG. 4 also features a spring controller 270. The spring controller 270 includes a spring-controller bore 280 sliding over the engine valve stem 24 as shown in FIG. 4, or the engine valve guide 120 if the engine valve guide 120 is longitudinally extended in the first direction. The spring controller 270 partitions a cavity in the engine cylinder head 68 into a spring-controller first and second chambers 272 and 274. The second chamber 274 is supplied, through a spring-controller port 296, with the working fluid from a fluid source P_SP. The first chamber 272 being preferably in communication with the atmosphere or a fluid return line (details of which not shown in FIG. 4). Structurally, the spring controller 270 and its associated chambers 272 and 274 and port 296 can be alternatively supported by an extended part of the housing 66, which is assembled on to the cylinder head 68.

The longitudinal position of the spring controller 270 results primarily from the balance between the fluid pressure force on a spring-controller second surface 278 in the first direction and the spring force from the first actuation spring 71*b* in the second direction, and it is limited in the first and second directions when spring-controller first and second surfaces 276 and 278 come in contact with spring-controller chamber first and second surfaces 292 and 294 respectively. The pressure of the fluid source P_SP can be switched between a high value and a low value to position the spring controller 270 in two end positions in the first and second directions, respectively. If desired, the pressure of the fluid source P_SP can also be continuously controlled to situate the controller 270 in between its two end positions. If so, because of the variability of the spring force with the engine valve opening and closing, some damping mechanism (not shown in FIG. 4) is needed to limit the position oscillation of the spring controller 270. The fluid source S_SP can be simply the high pressure P_H line. Alternatively, it can tap into the engine lubrication supply system, and the same fluid is used to lubricate the engine valve stem 24 and the engine valve guide 120.

When the spring controller 270 is at its second-direction end position (as shown in FIG. 4) because of a low or zero pressure in the second chamber 274 at a power-off state or during an actuator initialization, the two actuation springs 71*b* and 72*b* are at their least compressed state, and their static, net total force tends to move, by design, the engine valve 20 to a closed position, with an additional seating or contact force if desired. When the spring controller 270 is at its first-direction end position (not shown in FIG. 4) because of a high pressure in the second chamber 274, the two springs 71*b* and 72*b* are together at their most compressed state, and their static, net total force tends to bias the engine valve 20, in most designs, to a substantially middle point between the fully open and closed positions, setting up the system for its normal pendulum actuation. A position where the net or total spring force is zero is also called a neutral position. When desired, the engine valve neutral position can also be away from the substantial middle point between the fully open and closed positions. While the actuation springs 71*b* and 72*b* tend to bias the engine valve 20 to a neutral position, the actual position is also influenced by fluid forces on the actuation piston 32, the air forces on the engine valve head 22, inertia force during opening and closing, etc. The two springs 71*b* and 72*b* can be either identical or not identical in their designs and force curves.

The embodiment in FIG. 4 highlights the optional differential between the sizes or diameters of the first and second piston rods 34*b* and 36*b*, with the first piston rod 34*b* being visibly larger than the second piston rod 36*b*, resulting in an appreciably larger effective area on the actuation-piston second surface 100*b* than on the actuation-piston first surface 98*b*, and thus higher differential or net fluid force in the first direction than in the second direction under the identical pressure differential. If desired, the design can be reversed with the first piston rod 34*b* being smaller than the second piston rod 36*b* (not shown in FIG. 4) to achieve the opposite force effect. When desirable, one may completely eliminate the first piston rod 34*b* (not shown in FIG. 4) to achieve a greater net fluid force in the second direction.

The embodiment in FIG. 4 further features variations in the first and second flow mechanisms. The first-bore and second-bore undercuts 48*b* and 47*b* are extended longitudinally to the actuation-cylinder first and second ends 56 and 54, respectively. With this extension, the first-piston-rod and second-piston-rod necks 41 and 40 featured in FIGS. 1-3 are no longer necessary in FIG. 4 for the purpose of fluid communication. For flow restriction, the first-piston-rod and second-piston-rod shoulders 39 and 38 now work with the first-bore and second-bore undercuts 48*b* and 47*b*, respectively, instead of the first and second bores 44 and 46 as in FIGS. 1-3.

The embodiment in FIG. 4 also shows variations in the one-way fluid communication means or check valves, which are designed as the first and second reed valves 200 and 202 in FIGS. 1-3. They are optional. The fluid actuator may include only one check valve 202*b* as shown in FIG. 4 or no check valve at all. A check valve can be in the form of a reed valve shown in FIGS. 1-3 or other designs, such as a spring-loaded ball valve 202*b* in FIG. 4.

Figure 5:
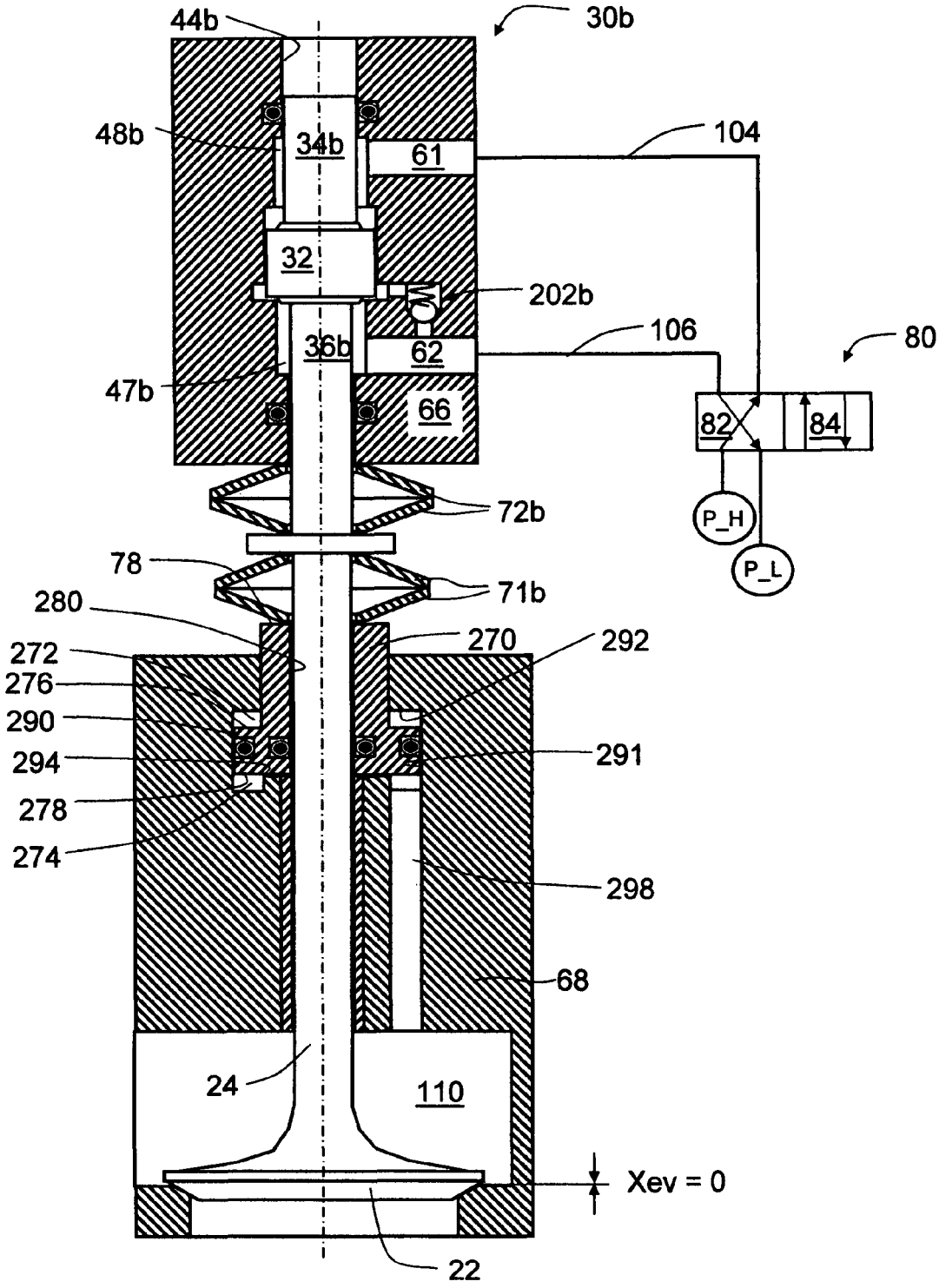
FIG. 5 is a schematic illustration of another preferred embodiment, which includes two piston rods with different diameters.

FIG. 5 depicts an alternative embodiment of the invention that features a spring controller passage 298 that provides fluid communication between the cross-over passage 110 and the spring-controller second chamber 274, which provides an alternative way to control the spring controller 270. When the power being off and the cross-over passage 110 and thus the spring-controller second chamber 274 being out of pressurized gas or air, the spring controller 270 is situated at the second-direction end position as shown in FIG. 5, resulting in a seated engine valve 20 under the spring forces. When the cross-over passage 110 being at a moderate to high pressure, the same pressure will be present in the spring-controller second chamber 274, resulting in appropriately compressed actuation springs 71*b* and 72*b*, fit for the normal pendulum operation.

Figure 6:
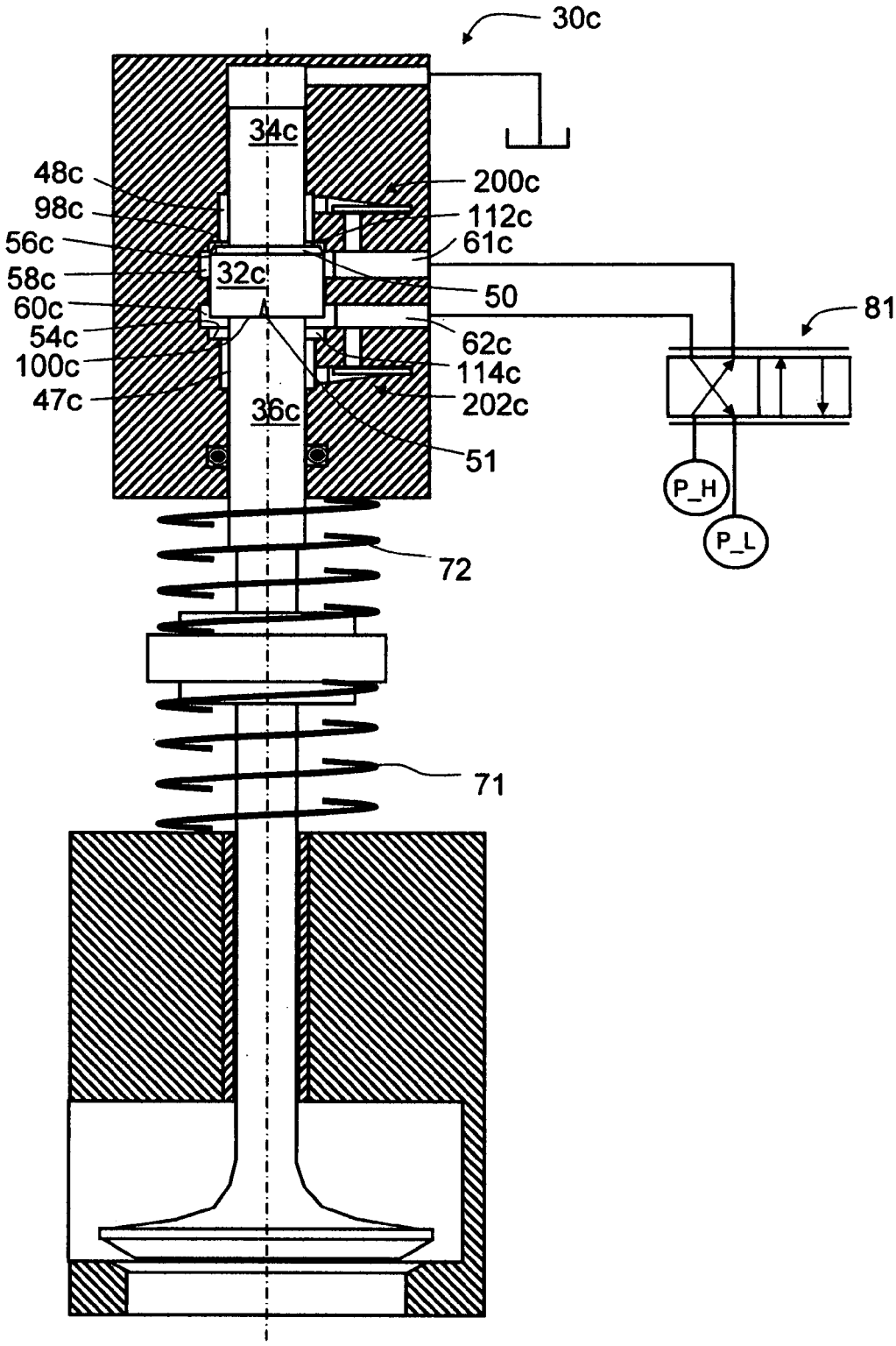
FIG. 6 is a schematic illustration of another preferred embodiment, which utilizes a proportional valve for control.

Refer now to FIG. 6, which is a drawing of yet another alternative embodiment of the invention. In this fluid actuator 30*c*, the first and second ports 61*c* and 62*c* are in direct fluid communication, respectively, with the actuation-cylinder first and second undercuts 58*c* and 60*c*, which are situated longitudinally a short distance away from the actuation-cylinder first and second ends 56*c* and 54*c*, respectively.

When the actuation-piston first surface 98*c* passes in the first direction the actuation-cylinder first undercut 58*c*, it substantially traps a certain amount of fluid in the first fluid space 112*c* and the first bore undercut 48*c* and creates snubbing action. The extent of the snubbing action can be designed into a taper 50 on the actuation piston 32*c*, which regulates the extent of flow leak back into the cylinder. The first bore undercut 48*c* is optional and is intended to work with an optional first check valve 200*c* to avoid cavitation or starvation when the actuation piston 32*c* moves away from the actuation-cylinder first end 56*c*.

Similarly, when the actuation-piston second surface 100*c* passes in the second direction the actuation-cylinder second undercut 60*c*, it substantially traps a certain amount of fluid in the second fluid space 114*c* and the second bore undercut 47*c* and creates snubbing action. The extent of the snubbing action can be designed into one or more slots 51 on the actuation piston 32*c*, which regulates the extent of flow leak back into the cylinder. The slots 51 can also be placed on a wall of the actuation cylinder, instead of the piston. Also, the taper 50 and the slots 51 can be interchanged to achieve the same snubbing function. The second bore undercut 47*c* is optional and is intended to work with an optional second check valve 202*c* to avoid cavitation when the actuation piston 32*c* moves away from the actuation-cylinder second end 54*c*. The first and second check valves 200*c* and 202*c* can be reed valves as shown in FIG. 6.

The embodiment in FIG. 6 also features an actuation proportional valve 81, which controls continuously the cross-section areas of its metering ports to achieve more controllability per performance requirements and operating conditions. While this proportional valve 81 is a 4-way valve, the actuation 3-way valves 180 and 182 featured in FIGS. 1-3 may also be replaced with corresponding 3-way proportional valves.

Figure 7:
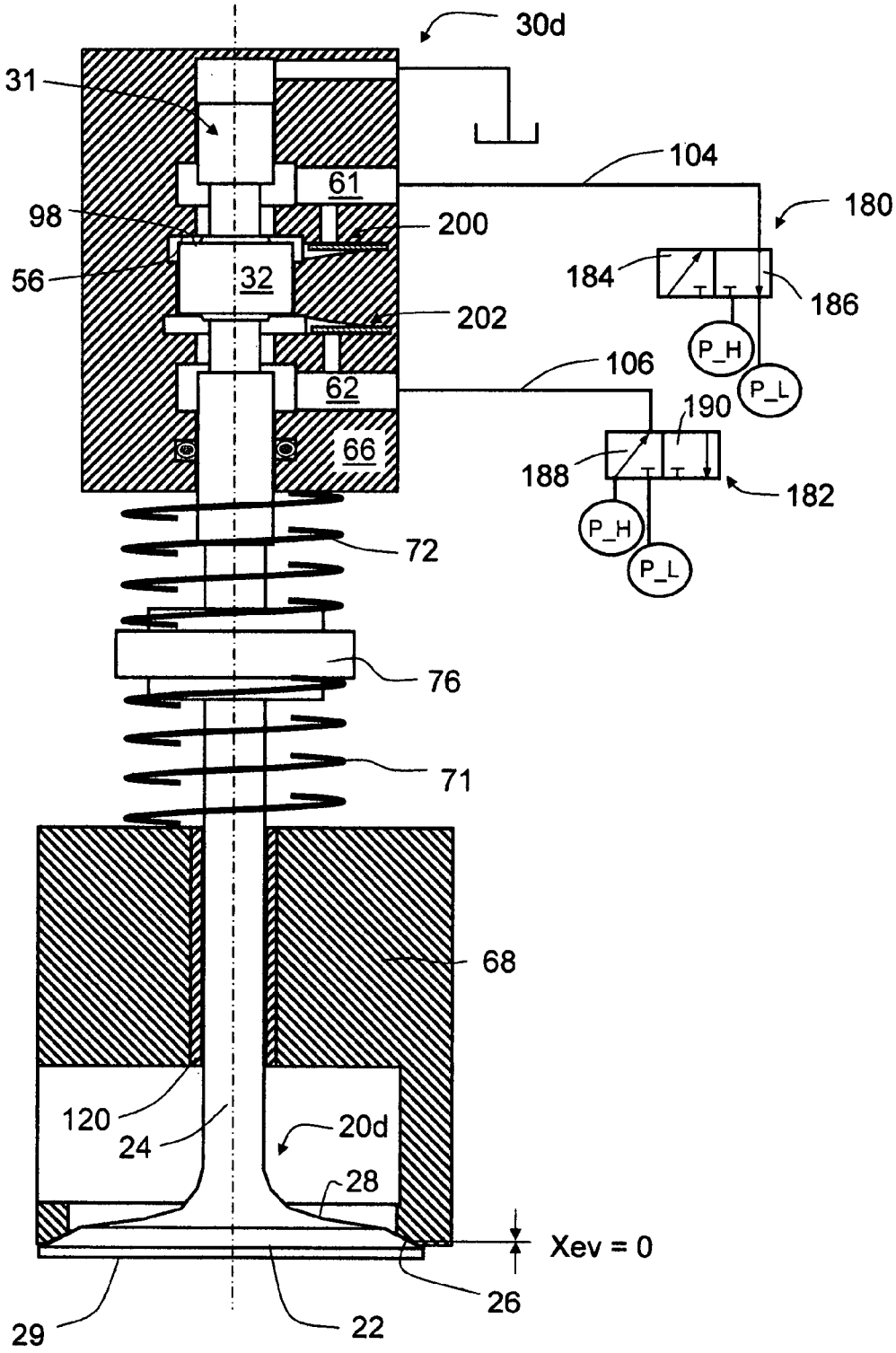
FIG. 7 is a schematic illustration of another preferred embodiment which opens an engine valve in the second direction.

Refer now to FIG. 7, which is a drawing of yet another alternative embodiment of the invention. In this case, the engine valve 20*d* is opened in the second direction as in most conventional internal combustion engines. When the engine valve 20*d* is closed as shown in FIG. 7, the actuation-piston first surface 98 is approximate to the actuation-cylinder first end 56, and there is a gap between them for the engine valve lash adjustment. Most of variations of the invention discussed above and implied otherwise also apply to the embodiment in FIG. 7.

In all the above descriptions, the first and second actuation springs 71 and 72 are each identified or illustrated, for convenience, as a single spring. When needed for strength, durability or packaging, however each or any one of the first and second actuation springs 71 and 72 may include a combination of two or more springs. In the case of mechanical compression springs, they can be nested concentrically, for example. The two actuation springs can also be combined into a single mechanical spring (not shown) that can take both tension and compression. They may also include a combination of pneumatic and mechanical springs, or even two pneumatic springs. The two springs can be either identical or not identical in their designs and force curves. The spring subsystem, either with a single or multiple springs, tends to return the shaft assembly to a neutral position. As a design option, the pneumatic springs may be filled, supplemented, or controlled by the pressurized air or gaseous mixture in the crossover passage 110. The pneumatic springs may have adjustable mass or pressure to achieve variable spring rate and thus variable valve stroke slope. Use of a pneumatic spring can also help close the engine valve 20 at power-off and start-up the valve system. If the first actuation spring 71 in FIG. 1 is a pneumatic one, for example, it can be discharged at power-off to bias the engine valve 20 in the second direction to a seated position, which also helps get the actuator ready for the next startup. After the next start-up, the pneumatic spring will be charged again. Also when desired, one can physically separate the two actuation springs and place one of them, for example the second actuation spring 72 or 72*b* at the first direction end of the fluid actuator, where it can be operably connected with the first piston rod 34 or 34*b* or 34*c*.

In all the above descriptions, each of the switch and/or control valves may be either a single-stage type or a multiple-stage type. Each valve can be either a linear type (such as a spool valve) or a rotary type. Each valve can be driven by an electric, electromagnetic, mechanic, piezoelectric, or fluid means.

In some illustrations and descriptions, the fluid medium may be assumed or implied to be in hydraulic or in liquid form. In most cases, the same concepts can be applied, with proper scaling, to pneumatic actuators and systems. As such, the term "fluid" as used herein is meant to include both liquids and gases. Also, in many illustrations and descriptions so far, the application of the invention is defaulted to be in engine valve control, and it is not limited so. The invention can be applied to other situations where a fast and/or energy efficient control of the motion is needed.

Although the present invention has been described with reference to the preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of this invention.

I claim:

1. A fluid actuator, comprising a housing having first and second fluid ports;

an actuation cylinder in the housing defining a longitudinal axis and having first and second ends in first and second directions;

an actuation piston in the cylinder with first and second surfaces moveable along the longitudinal axis;

a spring subsystem biasing the actuation piston to a neutral position;

a second piston rod operably connected with the actuation piston and the spring subsystem;

a first fluid space defined by the first end of the actuation cylinder and the first surface of the actuation piston;

a second fluid space defined by the second end of the actuation cylinder and the second surface of the actuation piston, and separated, within the actuation cylinder, from the first fluid space by the actuation piston in the entire travel range of the actuation piston;

a first flow mechanism controlling fluid communication between the first fluid space and the first port; and a second flow mechanism controlling fluid communication between the second fluid space and the second port.

2. The fluid actuator of claim 1, further comprising a first piston rod, operably connected with the first surface of the actuation piston.

3. The actuator of claim 2, wherein the first and second piston rods having two different predefined diameters, whereby resulting in appreciably different pressure areas on two actuation piston surfaces and thus appreciably different net fluid forces in the first and second directions under an identical pressure differential.

4. The fluid actuator of claim 1, further comprising at least one snubbing mechanism, whereby reducing the travel velocity of the actuation piston as it approaches at least one of its end positions.

5. The fluid actuator of claim 4, further comprising at least one check valve providing a one-way flow bypass around the at-least-one snubbing mechanism.

6. The fluid actuator of claim 5, wherein the at-least-one check valve is of the reed valve type.

7. The actuator of claim 1, wherein the spring subsystem further comprising at least one first actuation spring and at least one second actuation spring.

8. The actuator of claim 1, wherein the first and second ports being supplied by a first actuation 3-way valve and a second actuation 3-way valve, respectively.

9. The actuator of claim 1, wherein both the first and second ports being supplied by an actuation switch valve.

10. The actuator of claim 1, wherein both the first and second ports being supplied by an actuation proportional valve.

11. The actuator of claim 1, further comprising an engine valve operably connected with the second piston rod.

12. The actuator of claim 1, further comprising a spring controller, whereby controlling the state of compression of the spring subsystem.

13. The actuator of claim 1, wherein at least one of the first and second flow mechanisms including an annular space between a bore and a piston rod neck.

14. The actuator of claim 1, wherein at least one of the first and second flow mechanisms including an annular space between a bore undercut and a piston rod.

15. The actuator of claim 1, wherein at least one of the first and second flow mechanisms including an actuation-cylinder undercut.

* * * * *